United States Patent [19]

Herbst

[11] Patent Number: 4,923,733

[45] Date of Patent: May 8, 1990

[54] FLEXIBLE FORM SHEET

[76] Inventor: Donald Herbst, Marienplast 11, 1000 Berlin 45, Fed. Rep. of Germany

[21] Appl. No.: 302,421

[22] Filed: Jan. 26, 1989

[30] Foreign Application Priority Data

Jan. 29, 1988 [DE] Fed. Rep. of Germany ..... 3803062

[51] Int. Cl.[5] ..... B32B 3/00; B32B 3/28

[52] U.S. Cl. ..... 428/156; 428/180; 428/179; 428/174; 428/120; 52/220; 52/380; 52/381; 52/382; 249/117

[58] Field of Search ..... 249/117; 52/303, 220, 52/380, 381, 382; 428/180, 179, 174, 120, 156

[56] References Cited

U.S. PATENT DOCUMENTS

| | | | |
|---|---|---|---|
| 2,007,689 | 7/1935 | Merrill | 52/381 |
| 2,602,323 | 7/1952 | Leemhuis | 52/381 |
| 3,218,767 | 11/1965 | Stark | 52/381 |
| 3,288,998 | 11/1966 | Press, Jr. | 52/303 X |
| 3,334,458 | 8/1967 | Leemhuis | 52/381 X |
| 3,501,878 | 3/1970 | Segal | 52/356 |
| 3,575,781 | 4/1971 | Pezely | 428/180 |
| 4,144,369 | 3/1979 | Wass | 428/180 X |
| 4,637,184 | 1/1987 | Radtke et al. | 52/303 X |
| 4,640,854 | 2/1987 | Radtke | 428/179 X |

FOREIGN PATENT DOCUMENTS

| | | | |
|---|---|---|---|
| 3103632 | 12/1986 | Fed. Rep. of Germany | 52/303 |
| 1216990 | 12/1970 | United Kingdom | 428/179 |
| 1440249 | 6/1976 | United Kingdom | 52/303 |

*Primary Examiner*—Ellis P. Robinson
*Assistant Examiner*—William P. Watkins, III
*Attorney, Agent, or Firm*—Basile and Hanlon

[57] ABSTRACT

A flexible form sheet is described, which is used for producing plaster cavity floors. The sheet has regularly distributed, leg-like bulges. The bulges are interconnected by horizontal sheet surfaces. Increased flexibility areas are located between the bulges, and are preferably deformed. They are appropriately constructed as zigzag or concertina-like strips concentrically surrounding the bulges. This provides an increase in the vertical reciprocal mobility of the bulges, so that on applying the plaster, the form sheet can adapt to unevennesses of the underfloor.

7 Claims, 1 Drawing Sheet

FLEXIBLE FORM SHEET

FIELD OF THE INVENTION

The invention relates to a form or formwork foil or sheet for use in producing a plaster cavity floor, as well as to its production process.

BACKGROUND OF THE INVENTION

DE 31 03 632 C2 discloses a process for the production of a cavity floor, in which a form with a profiled, slightly flexible sheet material having a plurality of individual stud-like outward bulges forming supports or legs, is produced on an underfloor and to which is subsequently applied a flooring plaster. The bulges are arranged with reciprocal spacings such that the supports adapt to an uneven contour of the underfloor on applying the flooring plaster, the latter being applied as a fluid suspension. This is intended to bring about an adaptation of the form to uneven underfloors without additional compensating measures such as the placing of small plates under the supports. However, this known process, or the form sheet used for it, suffers from the disadvantages that the reciprocal spacing of the supports is given by the flexibility of the sheet and not the requirements made with regards to the cavity floor. However, this spacing must also be dependent on the maximum unevenness which occurs, i.e. it is much larger than would be necessary in the normal case. Thus, as a result of this provision of a minimum spacing, the sheet is not generally suitable as a form for cavity floors. Due to the relatively large distance between the individual bulges, the sheet must also be very stable and therefore very thick. Apart from a high material expenditure, this constitutes a high fire load in the building if, as is conventionally the case, the sheet is made from flammable plastic.

The problem of the present invention is therefore to improve the known form sheet in such a way that, despite the capacity to adapt to all unevennesses of the underfloor which are likely to occur, the spacing between the bulges can be kept so small that the sheet is usable for all cavity floors and can be relatively thin.

SUMMARY OF THE INVENTION

According to the invention this problem is solved by forming the sheet with clearly defined areas between the bulges providing increased flexibility as a result of a modification to the bending behavior. Advantageous developments of the inventive form sheet, as well as a preferred process for the production thereof can be gathered from the following description.

The invention is firstly characterized in that areas with increased flexibility are provided between the bulges. This increased flexibility is preferably obtained by a deformation of the areas, without having to modify the sheet thickness. It is particularly appropriate for said areas to have a zig-zag or concertina-like construction and advantageously surround the bulges in the form of concentric circles.

The form sheet can be particularly economically produced if the deformation of the increased flexibility areas takes place in one operation with the formation of the bulges, e.g. being pressed into the sheet material with the same form or mold.

BRIEF DESCRIPTION OF THE DRAWINGS

The invention is described in greater detail hereinafter relative to a non-limitative embodiment and the attached drawings, in which.

DESCRIPTION OF THE PREFERRED EMBODIMENT

Figure 1:
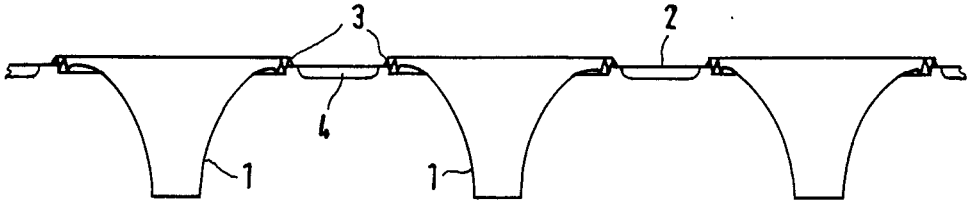
FIG. 1 is a cross-section through part of the form sheet.
Figure 2:
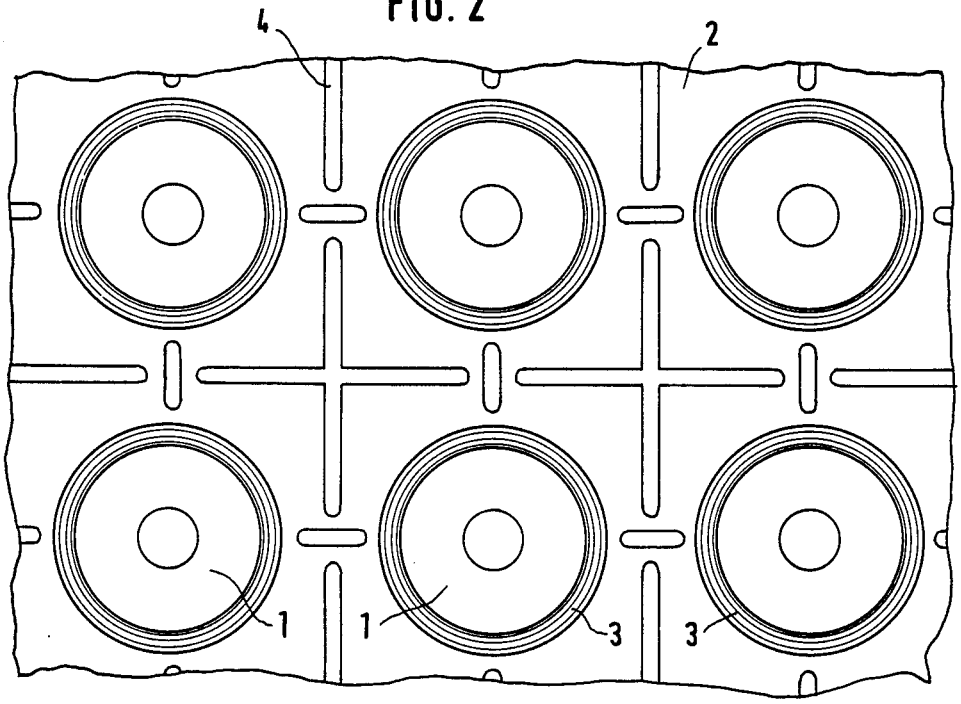
FIG. 2 a plan view of part of the form sheet.

The plastic, preferably polyvinylchloride, plate-like sheet has bulges 1 directed to one side, with regular spacings and in two directions at right angles to one another. The bulges for example, have a reciprocal spacing of 200 mm (7.874 inches) and a depth of 75 mm (2.953 inches). For forming the cavity floor, the sheet is placed on the underfloor with the bulges 1 directed downwards. A flooring plaster layer of the desired thickness is then applied and fills the upwardly open bulges 1 and, after setting, forms the legs or supports of the cavity floor. Between the supports or bulges 1, continuous cavities are obtained below the plaster layer and these can, for example, be used for receiving supply lines or for the passage of hot or cold air for the air conditioning of rooms.

The bulges 1 are interconnected by planar, horizontal sheet surfaces 2. In order to increase the flexibility of the flexible sheet, i.e. the mobility of the bulges 1 with respect to one another in the vertical direction, but without reducing the stability of the sheet as a formwork, preferably zig-zag or concertina-like folded areas 3 are arranged concentrically around each bulge 1 following the transition thereof into the horizontal surfaces 2. These areas form points of increased flexibility for the sheet, so that even in the case of a limited reciprocal spacing of the bulges 1, under the weight of the plaster applied, they can be moved vertically so far apart that, even in the case of larger unevennesses of the underfloor, each bulge 1 or each support is engaged firmly thereon. The limited spacing between the bulges 1 makes it possible for the sheet material to be relatively thin, while still withstanding the load by the plaster.

For this purpose, reinforcing beads 4, which pass downwards out of the horizontal surfaces 2, are arranged between areas 3. The beads 4 are constructed in a linear manner. In each case, two cruciform-intersecting beads 4 are provided between four adjacent concentric areas 3. In addition, beads 4 are provided wherever the distance between the two areas 3 is smallest. The beads 4 are at right angles to the beads 4 of the cruciform arrangements led up to the same on either side, so that a high reinforcing or stiffening effect is obtained.

What is claimed is:

1. A flexible form sheet for use in producing a plaster cavity floor, comprising a sheet with regularly distributed bulges and defined increased flexibility areas between the bulges as a result of a modification to bending behavior of the sheet, wherein the increased flexibility areas are deformed areas concentrically surrounding the bulges.

2. The sheet according to claim 1, wherein the deformed areas are constructed as zig-zag concertina-like strips.

3. The sheet according to claim 1, further comprising sheet-reinforcing deformations between the bulges and outside the increased flexibility areas.

4. The sheet according to claim 3, wherein the sheet-reinforcing deformations are constructed as beads.

5. The sheet according to claim 3, wherein at least part of the sheet-reinforcing deformations are arranged in cruciform manner between four increased flexibility areas.

6. The sheet according to claim 1, wherein the sheet is made from plastic.

7. The sheet according to claim 1, wherein a process for the production of a form sheet comprises the step of deforming increased flexibility areas in a single operation with construction of bulges.

* * * * *

UNITED STATES PATENT AND TRADEMARK OFFICE

CERTIFICATE OF CORRECTION

PATENT NO. : 4,923,733

DATED : May 8, 1990

INVENTOR(S) : Donald Herbst

It is certified that error appears in the above-identified patent and that said Letters Patent is hereby corrected as shown below:

On the title page, in the Inventor information, please delete "Marienplast" and insert --Marienplatz--.

Signed and Sealed this

Fourteenth Day of January, 1992

*Attest:*

*Attesting Officer*

HARRY F. MANBECK, JR.

*Commissioner of Patents and Trademarks*